United States Patent [19]

D'Amico

[11] Patent Number: 4,733,788

[45] Date of Patent: Mar. 29, 1988

[54] DRIPLESS FINGERNAIL POLISH BOTTLE

[76] Inventor: Joseph S. D'Amico, 19 Craigwood Cir., Russellville, Ark. 72801

[21] Appl. No.: 18,436

[22] Filed: Feb. 25, 1987

[51] Int. Cl.[4] ..... B65D 41/04

[52] U.S. Cl. ..... 215/295; 215/31; 401/121

[58] Field of Search ..... 215/228, 31, 295; 401/129, 121, 122

[56] References Cited

U.S. PATENT DOCUMENTS

| | | | |
|---|---|---|---|
| 668,053 | 2/1901 | Scattergood | 401/121 X |
| 791,309 | 5/1905 | Young | 401/121 |
| 2,093,189 | 9/1937 | Edmunds | 215/31 |
| 2,341,102 | 2/1944 | Kanzaki | 215/31 |
| 2,582,721 | 1/1952 | Roshkind | 215/228 X |
| 2,803,028 | 8/1957 | Flynn | 215/228 X |

FOREIGN PATENT DOCUMENTS

| | | | |
|---|---|---|---|
| 966895 | 3/1950 | France | 215/228 |

*Primary Examiner*—Donald F. Norton
*Attorney, Agent, or Firm*—Leon Gilden

[57] ABSTRACT

A fingernail polish bottle has a neck which includes a liquid-holding well formed interiorly of the external threads which receive and retain the bottle's cap. The well captures and collects fingernail polish which runs down the neck so as to prevent the polish from fouling the threads.

3 Claims, 4 Drawing Figures

DRIPLESS FINGERNAIL POLISH BOTTLE

BACKGROUND OF THE INVENTION

1. Field of the Invention

The present invention relates to fluid holding containers, and more particularly pertains to a new and improved fingernail polish bottle which is designed to prevent the accumulation of polish on the threads which receive and hold the bottle's cap.

2. Description of the Prior Art

A well recognized and currently existing problem with conventional fingernail polish bottles is the accumulation of polish on the cap and bottle neck threads. This accumulation of polish around the bottle threads and inside the bottle cap can make it virtually impossible to remove or replace the cap. The accumulation of polish results when the brush is removed and either wired or pessed along the top of the bottle neck in order to remove some excess polish. When the cap is replaced over the bottle neck threads, the accumulated polish runs down onto the threads and eventually hardens so as to result in the increased difficulty in removing or replacing the cap. Unfortunately, no commerically feasible solution to this problem has been developed and accordingly, there appears to be a continuing need for some type of solution to the problem of polish accumulation on bottle threads. In this respect, the present invention addresses this need.

SUMMARY OF THE INVENTION

In view of the forgoing disadvantages inherent in the known types of fingernail polish bottles now present in the prior art, the present invention provides an improved fingernail polish bottle construction wherein the threaded neck of the bottle is designed to include a well for capturing and accumulating polish spillover, thus to prevent the fouling of the threads by the polish. As such, the general purpose of the present invention, which will be described subsequently in greater detail, is to provide a new and improved fingernail polish bottle construction which has all the advantages of the prior art fingernail polish bottles and none of the disadvantages.

To attain this, the present invention comprises a fingernail polish bottle having a modified neck design. More specifically, the externally threaded neck of the bottle includes an interior neck portion having a circumferentially extending well designed therein. Excess nail polish will run down the interior neck and be captured in the well, while an exterior neck portion is provided with the threads which facilitate an attachment of the bottle's cap thereto. As such, the accumulation of the polish in the well interiorly of the threaded neck prevents the aforementioned fouling of the threads by the polish.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fingernail polish bottle which has all the advantages of the prior art fingernail polish bottles and none of the disadvantages.

It is another object of the present invention to provide a new and improved fingernail polish bottle which may be easily and efficiently manufactured and marketed.

It is a further object of the present invention to provide a new and improved fingernail polish bottle which is of a durable and reliable construction.

An even further object of the present invention is to provide a new and improved fingernail polish bottle which is susceptible of a low cost of manufacture with regard to both materials and labor, and which accordingly is then susceptible of low prices of sale to the consuming public, thereby making such fingernail polish bottles economically available to the buying public.

Still yet another object of the present invention is to provide a new and improved fingernail polish bottle which provides in the apparatuses and methods of the prior art some of the advantages thereof, while simulaneously overcoming some of the disadvantages normally associated therewith.

Still another object of the present invention is to provide a new and improved fingernail polish bottle which prevents the accumulation of polish spillover on the neck and cap threads.

Yet another object of the present invention is to provide a new and improved fingernail polish bottle which eliminates the problem of neck and cap fouling due to contained liquid spillover.

There together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
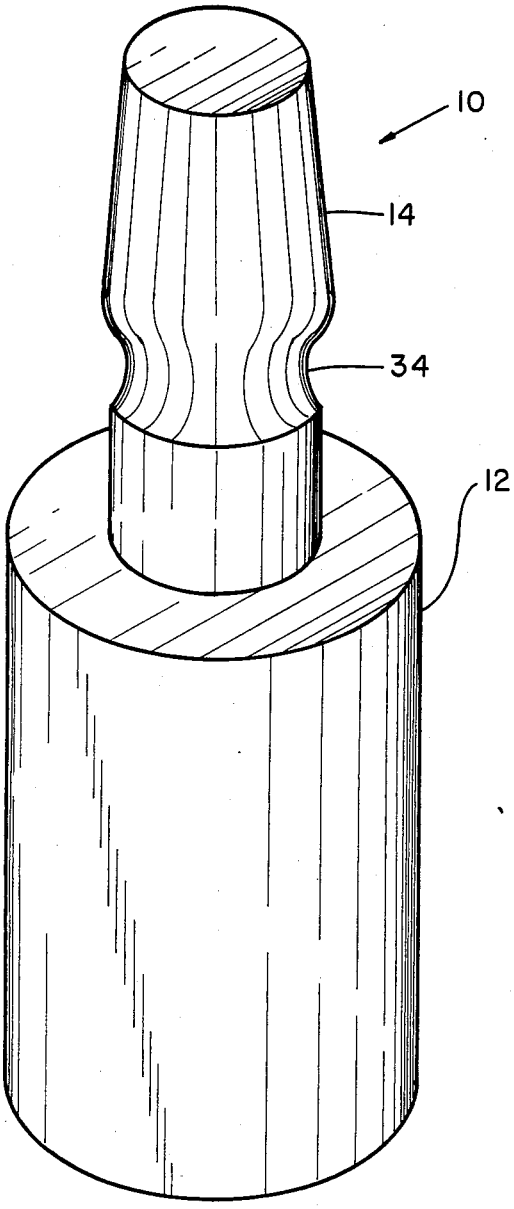
FIG. 1 is a perspective view of the dripless fingernail polish bottle comprising the present invention.
Figure 3:
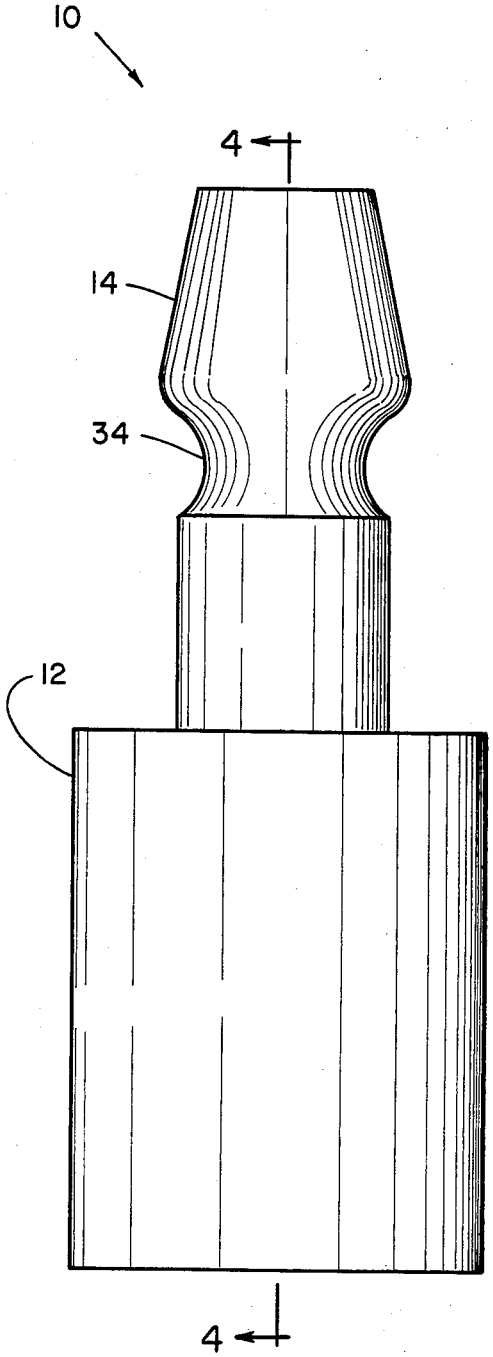
FIG. 3 is a typical side elevation view thereof.
Figure 2:
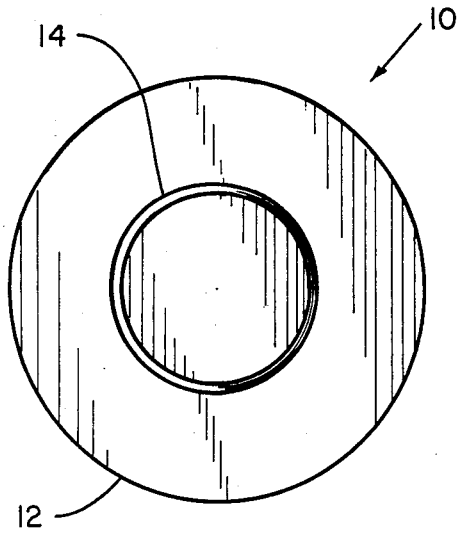
FIG. 2 is a top plan view of the invention.

With reference now to the drawings, and in particular to FIGS. 1–4 thereof, a new and improved fingernail polish bottle embodying the principles and concepts of the present invention and generally designated by the reference numeral 10 will be described.

More specifically, it will be noted that the bottle 10 comprises a conventional container 12 in which a quantity of fingernail polish is retained, with a threadably attachable cap 14 being utilized to close the container. As illustrated, the cap 14 includes a downwardly extending shaft member 16 having a brush section 18 on an end thereof, with this brush assembly being of a conventional design and being utilized to remove fingernail polish from the bottle 12 when desired. As illustrated, an interior section 20 of the cap 14 includes conventional threads which permit the threaded attachment of the cap to the neck 22 of the bottle 12.

Figure 4:
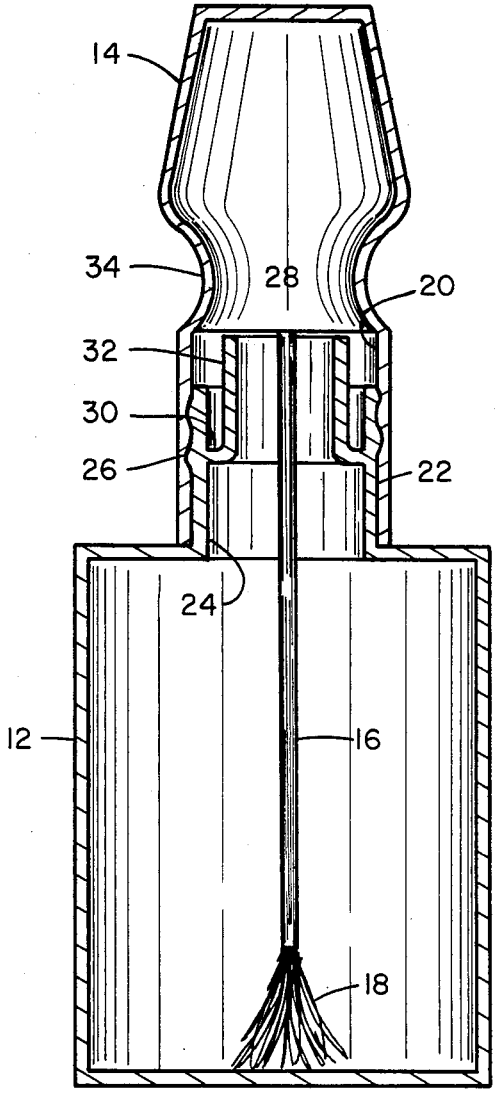
FIG. 4 is a cross-sectional view of the invention taken along the line 4—4 in FIG. 3.

With particular reference to FIG. 4 of the drawings, the novelty of the present invention is found to reside in the fact that the neck 22 includes an outer cylindrical section 24 having conventional external threads 26 formed thereon and a concentrically aligned, cylindrically shaped interior portion 28 integrally attached thereto. As illustrated, the integral attachment of the interior neck portion 28 to the exterior portion 26 defines a well 30. Additional noteworthy design features of the invention include a roughened surface 32 formed on an exterior portion of the inner neck 28, while the cap 14 may include a series of finger holes 34 around the periphery thereof which operates as an improved finger gripping means.

As to the manner of usage and operation of the present invention 10, it can be appreciated that a user of the fingernail polish bottle 12 would threadably remove the cap 14 therefrom and withdraw the brush 18 for the purpose of applying fingernail polish to finger nails. As the usage of the brush 18 continues, polish will spill over the bottle neck 22 and in particular over the inner neck portion 28. The roughened surface 32 will tend to retard polish flow downwardly and the well 30 will accumulate polish spillover so as to prevent it from fouling the threads 26 formed on the exterior neck section 24. As such, the threads 26 remain free and clear of polish spillover so that the cap 14 can be easily removed from and replaced upon the bottle 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the presented invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follow:

1. A new and improved liquid container designed to prevent liquid spillover from fouling threadably engageable container neck and closure threads, said container including liquid collection means comprising a well formed in a peripheral portion of said neck, said well is defined by an interior neck portion concentrically contained within and integrally attached to an exterior neck portion with threads formed on said exterior neck and further including a roughened surface on an exterior part or said interior neck portion, said roughened surface slowing a rate of liquid movement into said well, thereby to reduce the rate of liquid flow into said well, said liquid collection means capturing and retaining liquid spillover.

2. The new and improved liquid container as described in claim 1, and further including finger gripping means formed in said closure.

3. The new and improved liquid container as described in claim 1, wherein said container comprises a fingernail polish bottle and said liquid comprises fingernail polish.

* * * * *